US007331382B2

(12) United States Patent
Misiak et al.

(10) Patent No.: US 7,331,382 B2
(45) Date of Patent: Feb. 19, 2008

(54) HEAT EXCHANGER AND A METHOD OF MANUFACTURING A HEAT EXCHANGER MANIFOLD

(75) Inventors: Roman Misiak, Ostrow Wlkp (PL); Marek Filipiak, Ostrow Wlkp (PL); Andrzej Krupa, Ostrow Wlkp (PL)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/507,164

(22) Filed: Aug. 21, 2006

(65) Prior Publication Data

US 2007/0131385 A1 Jun. 14, 2007

(51) Int. Cl.
*F28F 9/02* (2006.01)

(52) U.S. Cl. ..... 165/173; 29/890.043; 29/890.052

(58) Field of Classification Search ..... 165/153, 165/173; 29/890.04, 890.052
See application file for complete search history.

(56) References Cited

U.S. PATENT DOCUMENTS 5,193,613 A * 3/1993 Wallis ..... 165/173
5,297,624 A * 3/1994 Haussmann et al. ..... 165/173
5,417,277 A * 5/1995 Le Gauyer ..... 165/76
5,743,329 A * 4/1998 Damsohn et al. ..... 165/174
5,842,515 A 12/1998 Kim ..... 165/175
5,894,886 A * 4/1999 Chiba et al. ..... 165/174
6,056,047 A * 5/2000 Gowan ..... 165/174
6,145,589 A * 11/2000 Gowan ..... 165/174

FOREIGN PATENT DOCUMENTS

EP 1515109 A2 * 3/2005

* cited by examiner

*Primary Examiner*—Allen J. Flanigan
(74) *Attorney, Agent, or Firm*—Patrick M. Griffin

(57) ABSTRACT

The present invention relates to a heat exchanger having a cooling core consisting of a plurality of parallel, heat exchanging tubes and two manifolds provided with slots, where the ends of heat exchanging tubes are inserted in fluid connection with each manifold and each slot is defined by a slot opening and parallel-running slot walls formed from deformed wall portions of the manifold. In order to improve a rigidity of construction of the heat exchanger the outer sides of said slot are deformed inwardly relative to the manifold wall, forming concavities in the manifold outer surface, the inner sides of said slot are deformed inwardly relative to the manifold wall, forming convexities in the manifold inner surface, and the convexities comprise grooves forming the slot walls in order to accommodate at least a portion of the longitudinal edges of the end of exchanging tube. A method of manufacturing such a heat exchanger manifold is also provided.

10 Claims, 4 Drawing Sheets

HEAT EXCHANGER AND A METHOD OF MANUFACTURING A HEAT EXCHANGER MANIFOLD

TECHNICAL FIELD OF INVENTION

The present invention relates to a heat exchanger having a cooling core consisting of a plurality of parallel, heat exchanging tubes and two manifolds provided with slots, where the ends of said heat exchanging tubes are inserted in fluid connection with each manifold, each slot being defined by a slot opening and parallel-running slot walls formed from deformed wall portions of the manifold. A method of manufacturing such a heat exchanger manifold is also provided.

BACKGROUND OF INVENTION

Typical heat exchangers comprise manifolds having apertures in which cooling core tubes are inserted. In such heat exchangers, the cooling core tubes remain in contact only with one wall of a tank. The surface of the resultant joint is therefore small, which decreases the rigidity of construction.

A solution to this problem is presented in U.S. Pat. No. 5,842,515, which discloses a heat exchanger comprising manifolds having flat bottomed portions formed with a plurality of apertures for receiving a plurality of corresponding heat exchanging tubes, a pair of vertical walls extending from opposing sides of the flat bottom portion and having a plurality of grooves corresponding to the apertures for guiding the tubes. A pair of connecting portions extending transversely or bulging outward from the vertical walls is provided and joined together in order to form a hollow inner space and to define the outer surface of the manifold.

Another solution to the problem is proposed in U.S. Pat. No. 5,743,329, the specification of which discloses a heat exchanger having a manifold with an outer and an inner casing, and comprising at least one slot lying in a plane roughly perpendicular to a longitudinal axis of said manifold, said slot being defined by narrow sides which are limited by parallel-running slot walls of the manifold which extend roughly along a tangent to a circle around the manifold longitudinal axis. The slot width is equal to at least the manifold inner diameter and therefore the slots are capable of accepting flat heat exchanging tubes. The walls of the slots are formed from deformed wall portions of the manifold having a constant wall thickness, and the outer sides of the slot walls lie outside the outer casing of the manifold. The inner sides of said slot walls are offset radially outward relative to the manifold inner casing and a shoulder is formed between the slot walls and the manifold inner casing.

An object of the present invention is to provide a heat exchanger having an improved rigidity of construction, where the manifolds are connected with the ends of heat exchanging tubes in a stable and precise manner. Another object of the present invention is to provide an uncomplicated and robust method of manufacturing heat exchanger manifolds, which facilitates preliminary assembly and manufacture of the heat exchanger manifolds such that they may subsequently be incorporated into the resultant heat exchanger.

SUMMARY OF THE INVENTION

According to the present invention, there is provided a heat exchanger, where the outer sides of a slot are deformed inwardly relative to the manifold wall, forming concavities in the manifold outer surface, the inner sides of said slot are deformed inwardly relative to the manifold wall, forming convexities in the manifold inner surface, and wherein the convexities comprise grooves forming the slot walls in order to accommodate at least a portion of the longitudinal edges of the end of exchanging tube.

According to the present invention, there is also provided a method of manufacturing a heat exchanger manifold according to the invention, which comprises the steps of:

(i) forming a tubular closed profile of a manifold, (ii) deforming the profile walls inwardly from both sides in order to form a pair of concavities and convexities respectively in manifold outer and inner surface, (iii) lancing the manifold between each pair of convexities in order to form slots openings surrounded by inwardly deformed curved manifold wall portions, and (iii) cutting grooves into each pair of convexities.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

The present invention will now be described, by way of example only, with reference to the following drawings in which.

DETAILED DESCRIPTION OF INVENTION

Figure 1:
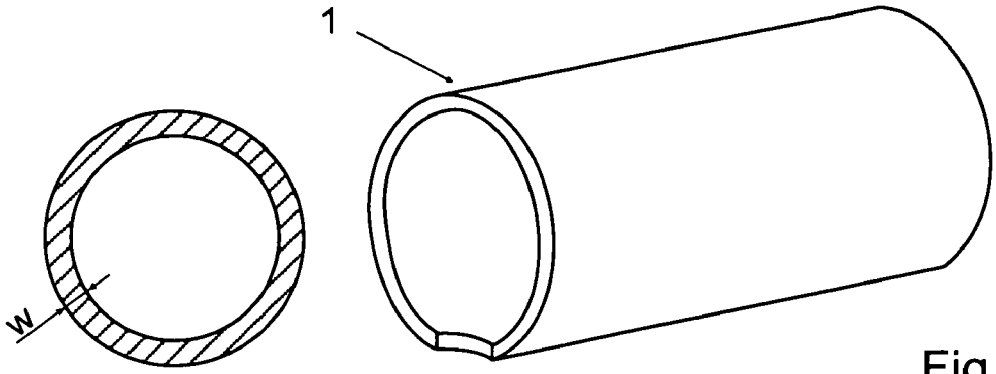
FIG. 1 illustrates a fragment of an initial manifold profile in a cross-section and an axonometric view.

A heat exchanger manifold 1 according to the present invention can be manufactured from an initial closed aluminium alloy profile of a wall thickness (w), as shown in FIG. 1. Profiles of this kind are commercially available or may alternatively be manufactured according to typical methods known to a person skilled in the art, e.g. by a welding or extrusion process.

Figure 2:
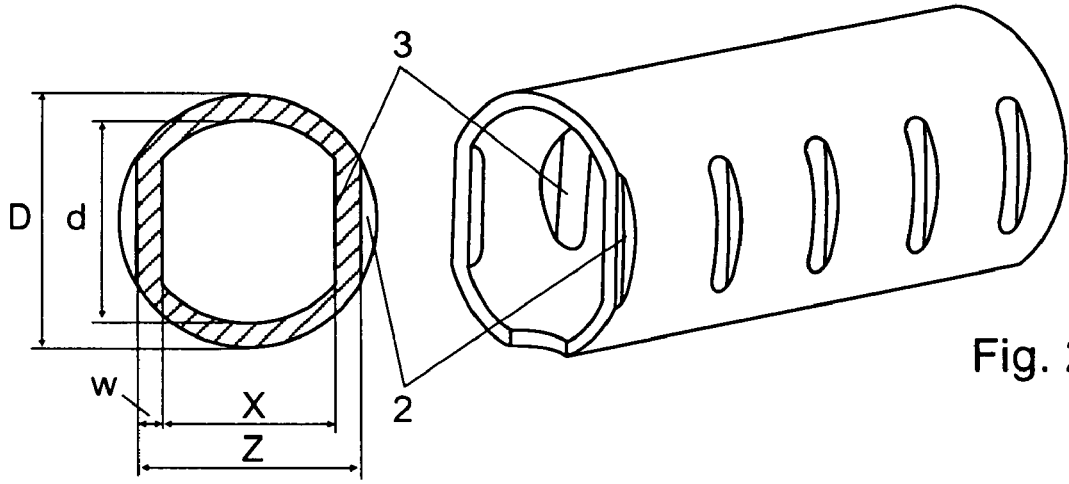
FIG. 2 illustrates a fragment of an initial manifold profile in a cross-section and an axonometric view after forming concavo-convex dents.

As shown in FIG. 2, in the next step of the method according to the invention, the wall of the tubular manifold 1 profile is deformed inwardly on opposite sides of the manifold, perpendicularly to the longitudinal axis of the manifold, in order to form a set of concavo-convex dents having concavities 2 and corresponding convexities 3, respectively in the outer and inner surface of the manifold 1.

Due to this deformation, the distance (Z) between the bottoms of the concavities 2 is less than the manifold outer diameter (D), while the distance (X) between the tops of the convexities 3 is less than the manifold inner diameter (d). The wall thickness (w) of the manifold profile between the concavities 2 and the convexities 3 is substantially the same as the thickness of the manifold wall elsewhere.

Figure 3:
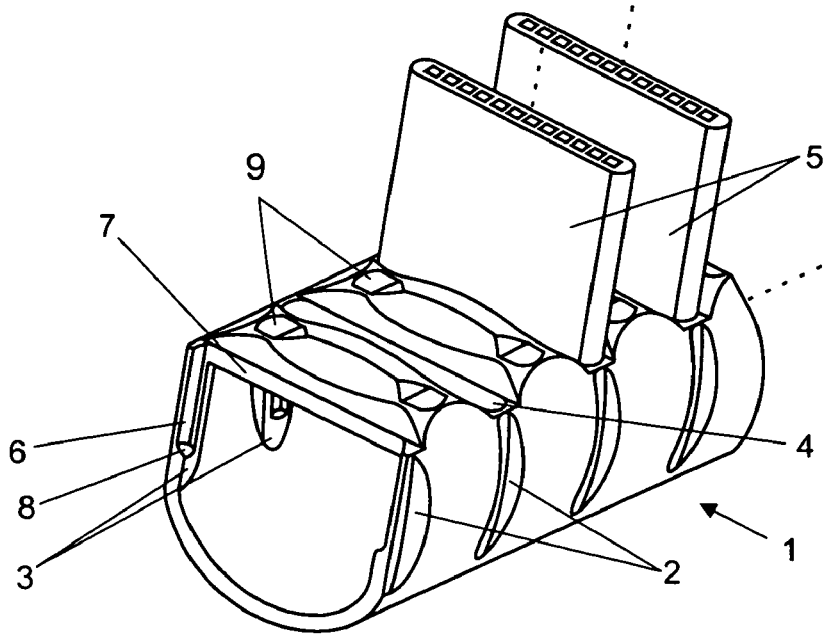
FIG. 3 illustrates a fragment of a finished manifold with two heat exchanging tubes inserted into corresponding slots.

A fragment of a finished manifold 1 is shown in FIG. 3. Each pair of concavo-convex dents forms a base structure for a slot 4 of a heat exchanging tube 5. Slots 4 are formed by lancing the manifold wall down the tops of the convexities 3 and the shape of each slot 4 corresponds to the end cross sectional shape of each heat exchanging tube 5 that is to be inserted therein. Structural details of the slots and a process of lancing thereof shall be described later, in particular with reference to FIG. 4.

Although, for the clarity of the drawing, the manifold after the step of inward deformation (FIG. 2) is shown separately to the manifold after the step of forming the slots (FIG. 3), it shall be understood that it is possible and advantageous to combine the step of providing the concavo-convex dents in the manifold walls and the step of lancing the slots into a single operation using a suitable tool.

Two substantially flat heat exchanging tubes 5 are shown inserted into corresponding slots 4 of the manifold 1. The entire heat exchanger comprises two manifolds 1 connected by a plurality of parallel heat exchanging tubes 5. After preliminary assembling, the heat exchanger is placed inside an oven where it undergoes a one shot brazing operation.

The process of lancing the manifold wall down the tops of the convexities 3 forms rounded grooves 6 in the convexities 3. These grooves 6 have outward ends which merge into the outer edges of the slot opening 7. The grooves 6 increase the surface area of the junction between the tubes 5 and the manifold 1 and thus the joint between the tubes 5 and the manifold 1 is more rigid and the whole construction of the heat exchanger is structurally stronger.

Moreover, the grooves 6 facilitate guiding the tubes 5 into the manifold 1 during preliminary assembling of the heat exchanger and for this purpose they are precisely fitted to the longitudinal edges of the tubes 5. Additionally, the grooves 6 comprise inward shoulders 8 blocking further movement of the ends of the tubes. These ensure that each tube 5 is inserted into the slot 4 of the manifold 1 by the same distance until it abuts on the corresponding shoulder 8 of the groove 6.

In this embodiment of the manifold, the walls between neighbouring slot openings 7 comprise flat portions 9 made during the last stage of lancing the manifold slots. Flat portions 9 reduce the effect of hour-glassing shape deformation on the lanced openings 7 and ensure a uniform breadth of the manifold openings.

Figure 4:
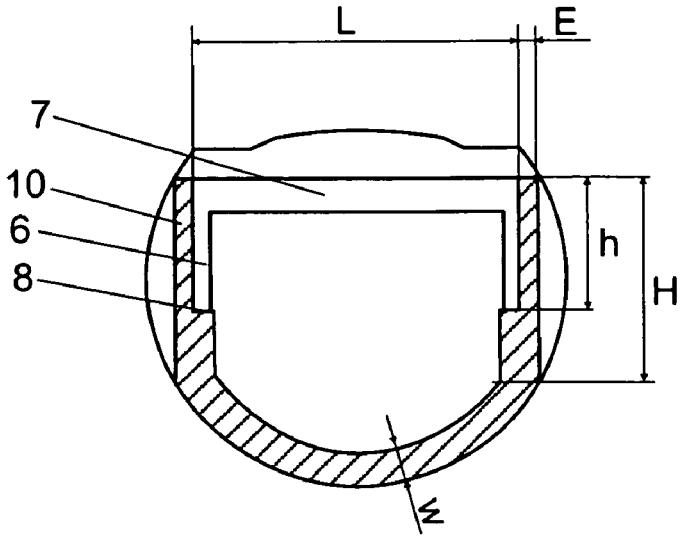
FIG. 4 is a cross-section of one slot of FIG. 3.
Figure 5:
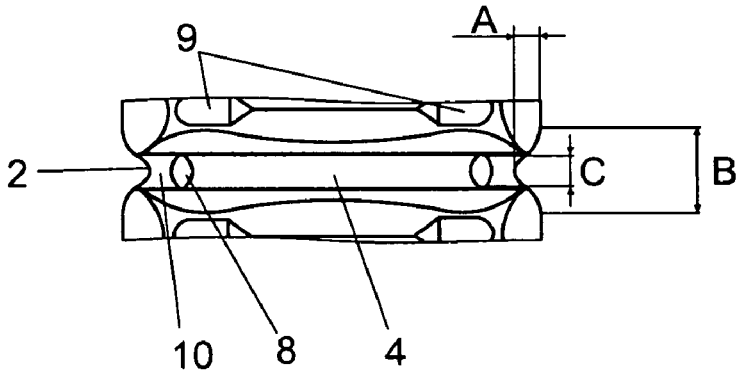
FIG. 5 is a top view of the slot of FIG. 4.

FIG. 4 and FIG. 5 show a cross-section of the slot 4 with all its essential features and dimensions. The slot opening width (L) or the distance between slot grooves corresponds to the width of the tube 5, while the distance between the slot opening 7 and the inward shoulders 8 of the grooves 6 determines the slot depth (h) equivalent to tube 5 insertion depth. The depth (h) of the slot is smaller than the total length (H) of the convexity in which the groove 6 is formed. In the case of a tubular manifold, the maximum allowable depth (h) of the slot groove 6 obviously depends on the length (H) of the convexity 3. The thickness (E) of the slot wall 10 is smaller than the wall thickness w of the initial manifold profile.

As shown in the top view of FIG. 5, the breadth (B) of the concavity 2 is greater than the breadth (C) of the slot 4. Furthermore, for tubular manifold profiles, the depth (A) of the concavities determines the length of the convexity (H) and thus the allowable maximum depth h of the slot groove 6.

Figure 6:
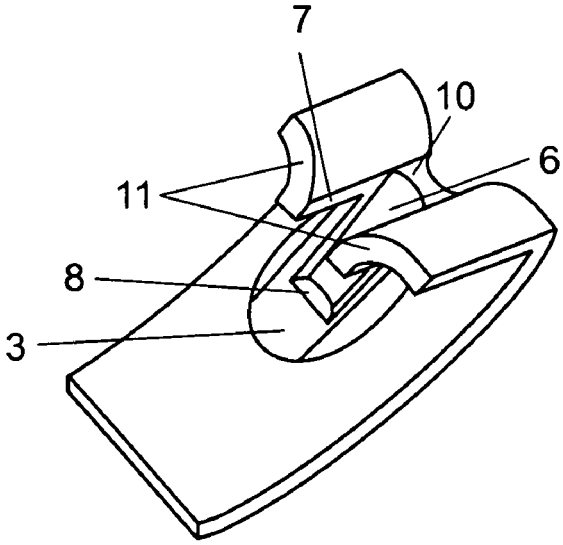
FIG. 6 is an axonometric view of a fragment of the slot of FIG. 4, showing details of its construction in a vicinity of the slot groove.

Referring to FIG. 6 which shows the structure of the manifold wall in the vicinity of the slot, it is clear that the longitudinal sides of the slot opening 7 are surrounded by curved manifold wall portions 11 formed by the lancing operation. This is a result of a combination of notching and bulging caused by the lancing operation and results in an enlarged contact surface area between the heat exchanging tube and the manifold 1.

A suitable tool for manufacturing the slots would have a pair of integrally formed cutting and shaping members which combine the steps of forming the concavo-convex slot dents, lancing the slot openings and forming the grooves into a single process.

The tool may also comprise a punching portion for forming the flat portions 9 in the manifold profile during lancing of the slots 4.

Obviously the slots may be manufactured serially one after the other using a suitable tool and displacing the manifold profile by a predefined distance between two slots after each denting/lancing/cutting of a slot or, more preferably, simultaneously using a set of coupled tools disposed and spaced parallel by the distance between two slots.

It should be understood that the slots may also be manufactured using other types of a tool than that previously described. The method according to the invention may be used to form various shapes of slots such as, for example, rectangular, circular or ovals. Furthermore, the process may be easily implemented and automated.

Figure 7A:
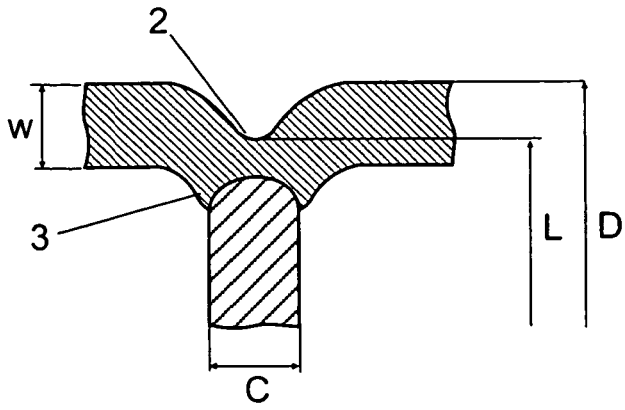
FIGS. 7*a*, 7*b*, 7*c* and 7*d* show a cross-section of a slot along the manifold wall with a fragment of a heat-exchanging tube for four different embodiments of the slot.
Figure 7B:
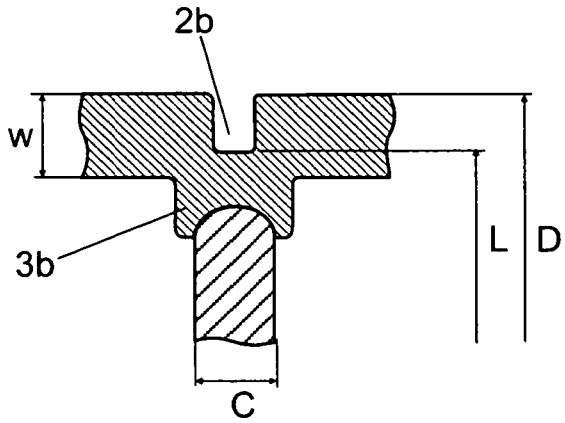
Figure 7C:
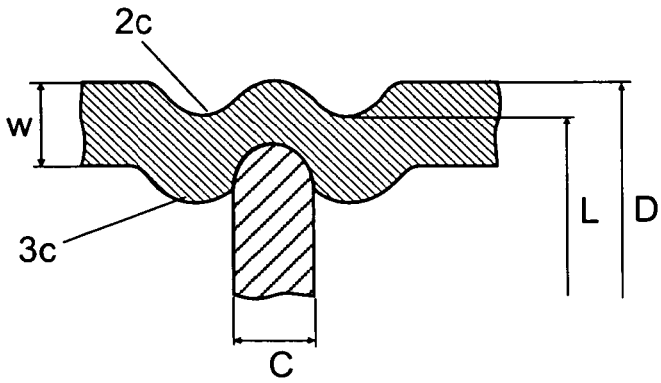
Figure 7D:
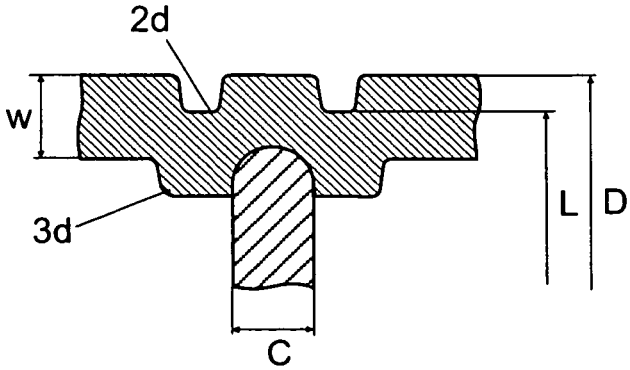

FIGS. 7*a* to 7*d* show exemplary shapes of the slot in a cross-section along the manifold wall. FIG. 7*a* shows a slot where the concavities 2 and convexities 3 are substantially oval. A slot with substantially rectangular concavities 2*b* and convexities 3*b* is shown in FIG. 7*b*. FIG. 7*c* shows the slot with bifold concavities 2*c* and corresponding bifold convexities 3*c*, which may be formed e.g. by using a tool with squeezing elements appropriately shaped to reflect the shape of the dents. FIG. 7*d* shows a slot having bifold concavities 2*d* and convexities 3*d* of a substantially rectangular shape.

Figure 8:
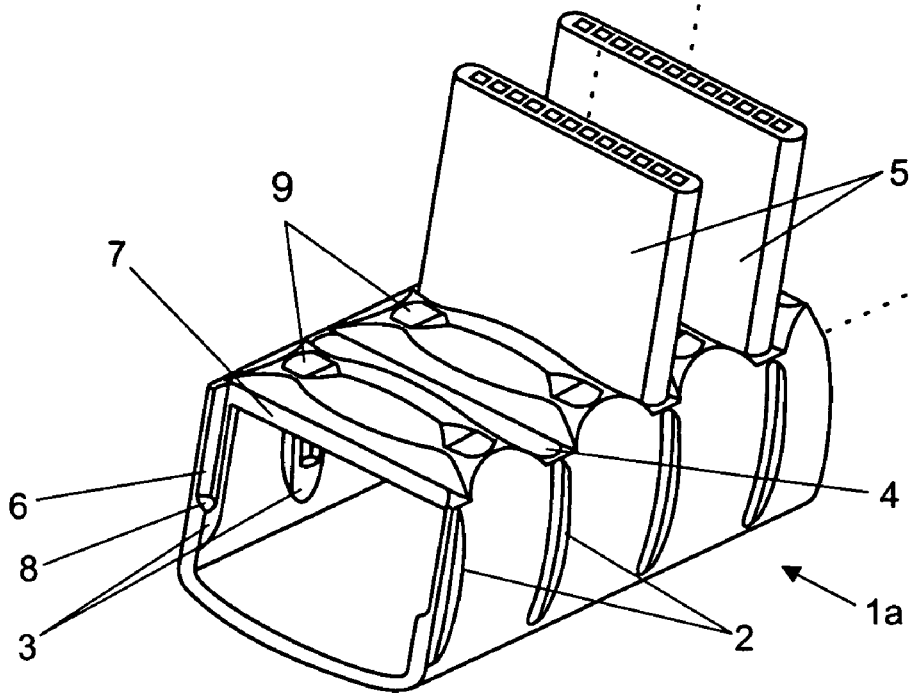
FIG. 8 illustrates a fragment of another embodiment of a manifold having a rectangular cross-section in an axonometric view.

FIG. 8 shows another exemplary embodiment of a manifold 1*a* according to the invention having a rectangular cross-section. In contrast to the manifold of FIG. 3, this profile comprises dents having convexities and concavities of substantially constant depth along the height of the manifold profile.

The above embodiments of the heat exchanger according to the present invention are merely exemplary. The figures are not necessarily to scale, and some features may be exaggerated or minimized. It will be also understood to a person skilled in the art that the heat exchanger can be a radiator or condenser of a motor vehicle air conditioning system.

While this invention has been described in terms of the preferred embodiments thereof, it is not intended to be so limited, but rather only to the extent set forth in the claims that follow.

We claim:

1. A heat exchanger having a cooling core comprising at least a heat exchanging tube and at least a manifold provided with slots, where an end of said heat exchanging tube is inserted in fluid connection with said manifold, each slot being defined by a slot opening and slot walls formed in deformed wall portions of said manifold, characterised in that the outer sides of said slot are deformed inwardly relative to said manifold wall thereby providing concavities in said manifold outer surface, the inner sides of said slot are deformed inwardly relative to said manifold wall, thereby providing convexities in said manifold inner surface, and grooves are formed in said convexities which provide said slot walls, in order to accommodate at least a portion of the longitudinal edges of the end of said exchanging tube.

2. The heat exchanger as recited in claim 1, characterised in that the inner ends of said grooves are limited by shoulders which limit the depth of insertion of the ends of the heat exchanging tubes into said manifold.

3. The heat exchanger as recited in claim 1, characterised in that said manifold comprises flat portions between neighbouring slots openings.

4. The heat exchanger as recited in claim 2, characterised in that said manifold comprises flat portions between neighbouring slots openings.

5. The heat exchanger as recited in claim 1, characterised in that said manifold is tubular and has a substantially rectangular or oval cross-section.

6. The heat exchanger as recited in claim 2, characterised in that said manifold is tubular and has a substantially rectangular or oval cross-section.

7. The heat exchanger as recited in claim 3, characterised in that said manifold is tubular and has a substantially rectangular or oval cross-section.

8. The heat exchanger as recited in claim 4, characterised in that said manifold is tubular and has a substantially rectangular or oval cross-section.

9. A method of manufacturing a heat exchanger manifold comprising a plurality of slots adapted to accommodate heat exchanging tubes, where the ends of said heat exchanging tubes are inserted in fluid connection with each manifold, and each slot is defined by a slot opening and slot walls formed from deformed wall portions of said manifold, characterised in that said method comprises the steps of:

(i) forming a tubular closed profile of a manifold, (ii) deforming the profile walls inwardly from both sides in order to form a pair of concavities and convexities respectively in said manifold outer and inner surface, (iii) lancing said manifold between each pair of convexities in order to form slot openings surrounded by inwardly deformed curved manifold wall portions, and (iii) cutting grooves into each pair of convexities.

10. The method of manufacturing a manifold of a heat exchanger as recited in claim 9, characterised in that it further comprises the step of forming flat portions between neighbouring slots openings.

* * * * *